US006583700B1

(12) United States Patent
Beadle

(10) Patent No.: US 6,583,700 B1
(45) Date of Patent: Jun. 24, 2003

(54) TRANSFORMER ASSEMBLY FOR ENVIRONMENTAL LIGHTING SYSTEM

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 53 days.

(21) Appl. No.: 09/948,161

(22) Filed: Sep. 7, 2001

(51) Int. Cl.[7] ..... H01F 27/02
(52) U.S. Cl. ..... 336/90; 362/240; 362/362
(58) Field of Search ..... 336/65, 82, 83, 336/90, 92; 362/236, 237, 240, 362–375, 145

(56) References Cited

U.S. PATENT DOCUMENTS 4,290,094 A * 9/1981 Jensen ..... 362/145
4,974,134 A * 11/1990 Bourne ..... 362/286
5,911,499 A * 6/1999 Stafford et al. ..... 362/240

* cited by examiner

*Primary Examiner*—Tuyen T. Nguyen
(74) *Attorney, Agent, or Firm*—Kilpatrick Stockton LLP

(57) ABSTRACT

The transformer assembly comprises a housing with a top portion having a cavity within which a transformer is sealed using a waterproof sealant and a body portion which is generally hollow for supporting the top portion and for providing a pathway for feeding wires into the housing for connection to the transformer. The transformer is mounted on a plate retained within the top portion of the housing. The plate, which has a plurality of holes therethrough, supports at least one circuit breaker and at least one liquid-tight fitting through which wires are passed to connect to the transformer. The at least one circuit breaker is positioned over an opening through the plate allowing access to its reset switch. The at least one circuit breaker is sealed within flexible silicone boots so that both the top and bottom of the circuit breaker are sealed against moisture while still allowing the reset switch to be pressed. The top portion is filled with a moisture proof epoxy which encases the transformer, the at least one circuit breaker and upper boot, the upper surface of the plate, all fasteners that are used to attach the transformer and at least one circuit breaker to the plate, and the upper ends of the liquid tight fittings.

27 Claims, 3 Drawing Sheets

TRANSFORMER ASSEMBLY FOR ENVIRONMENTAL LIGHTING SYSTEM

FIELD OF THE INVENTION

The invention is directed generally to transformers for environmental lighting systems, and more particularly to a transformer assembly for minimizing voltage drop in a low voltage environmental lighting system.

BACKGROUND

Environmental lighting systems typically operate by providing low voltage to a number of lamps which are located to enhance various features in the environment, such as statues, trees, or flower beds, or to illuminate traffic areas for safety. The low voltage, usually 12 volts, is produced by one or more transformers that are connected to a 120 VAC source and positioned within the area covered by the lighting system in a way to ensure a stable voltage supply to the lamps. When using only one transformer, it is important to center the transformer on the wattage load. A primary goal in laying out low voltage lighting systems is to minimize cable runs because of the adverse affect voltage drop has on lamp performance and lifetime. Furthermore, the copper direct burial cable used in low voltage lighting systems is expensive, so the lengths of cable runs are preferably minimized for economy as well. Cables to lamps at the greatest distance from the transformer require an initially higher output voltage and/or a heavier gauge cable in order to compensate for the voltage drop over long stretches of cable and multiple lamps. The use of multiple transformers within a system provides better lamp performance as long as each transformer is placed to minimize cable runs. Also, multiple transformers permit selective control of light in different zones within the overall lighting system.

Most existing transformer assemblies were built for industrial applications, i.e., they are not designed with aesthetics in mind. Furthermore, the transformers are traditionally hung on a post or wall in a rain-tight box, so that they are at least one foot (0.3 m) above the ground (to comply with NEC (National Electrical Code) requirements.) Thus, in order to avoid detracting from the overall appearance of the lighted area, it is generally preferred that the transformer be placed inconspicuously, on the side of a building or inside a structure. This is a problem, however, in areas such as island planters surrounded by traffic or seating areas, or by a decorative feature such as a pond or pool, which rarely provide any suitable cover for concealing the unattractive box. There are also vandalism and safety concerns which influence the decision in placement of the transformer box in a hidden location. The desire to conceal the box, however, increases the challenge in minimizing the distance between the lamps and the transformer.

One solution to the difficulty in placement of conventional transformer boxes is to use direct burial transformers, which can be located close to the lamps without being an eyesore. However, such transformers suffer from a range of problems since it is almost impossible to completely waterproof a buried enclosure since the installer must run both 120 V input and 12 V output wiring into and out of the enclosure. Also, the user needs relatively easy access to the interior to reset circuit breakers, which have a greater tendency to fail in humid conditions, such that factory seals at both the top and bottom of the enclosure are broken. These problems are combined with the siphoning phenomenon caused by the heating and cooling of the interior of the enclosure, virtually guarantying that the transformer will fail over time.

Accordingly, the need remains for a transformer assembly for low voltage lighting systems which can be safely placed so as to minimize the lengths of cable needed to reach the lamps without detracting from the appearance of the area to be lighted. The transformer assembly described herein is addressed to and provides a solution for such a need.

SUMMARY OF THE INVENTION

In an exemplary embodiment, the transformer assembly comprises a housing with a top portion having a cavity within which a transformer is sealed using a waterproof sealant and a body portion which is generally hollow for supporting the top portion and for providing a pathway for feeding wires into the housing for connection to the transformer. The transformer is mounted on a plate retained within the cavity in the top portion of the housing. The plate, which has a plurality of holes therethrough, supports at least one circuit breaker and at least one liquid-tight fitting through which wires are passed to connect to the transformer. The at least one circuit breaker is positioned over an opening through the plate allowing access to its reset switch. The at least one circuit breaker is sealed within flexible silicone boots so that both the top and bottom of the circuit breaker are sealed against moisture while still allowing the reset switch to be pressed. The top portion, which in the preferred embodiment is generally dome-shaped, is filled with epoxy within encases the transformer, the at least one circuit breaker and upper boot, the upper surface of the plate, all fasteners that are used to attach the transformer and at least one circuit breaker to the plate, and the upper ends of the liquid tight fittings.

In the preferred embodiment, the top portion of the housing is formed from copper which will patine into natural shades of greens and browns to complement a garden setting. Alternatively, the top portion can be a powder-coated metal in a color that will fit into the surrounding area. A lip formed on the lower edge of the top portion has a diameter adapted to fit over the outer diameter of the body portion. Slots formed in the lip allow a screw or other fastener to pass through into a threaded opening in the body portion to fasten the top portion to the body. The body portion can be formed from plastic, polymer, powder-coated metal, copper, brass or other material. A plurality of vertically-extending channels or ribs are formed in the outer surface of the body portion to prevent the top portion from seizing up and preventing removal of the top from the body portion. In the preferred embodiment, the body portion is a hollow cylinder, i.e., has a circular cross-section, however, other shapes may be used, including those having a cross-section that is an oval, or a polygon such as a triangle, square, hexagon, octagon, etc.

BRIEF DESCRIPTION OF THE DRAWINGS

The accompanying drawings, which are incorporated in and form a part of the specification, illustrate embodiments of the present invention and, together with the description, disclose the principles of the invention, wherein.

DETAILED DESCRIPTION OF THE PREFERRED EMBODIMENT

Figure 1:
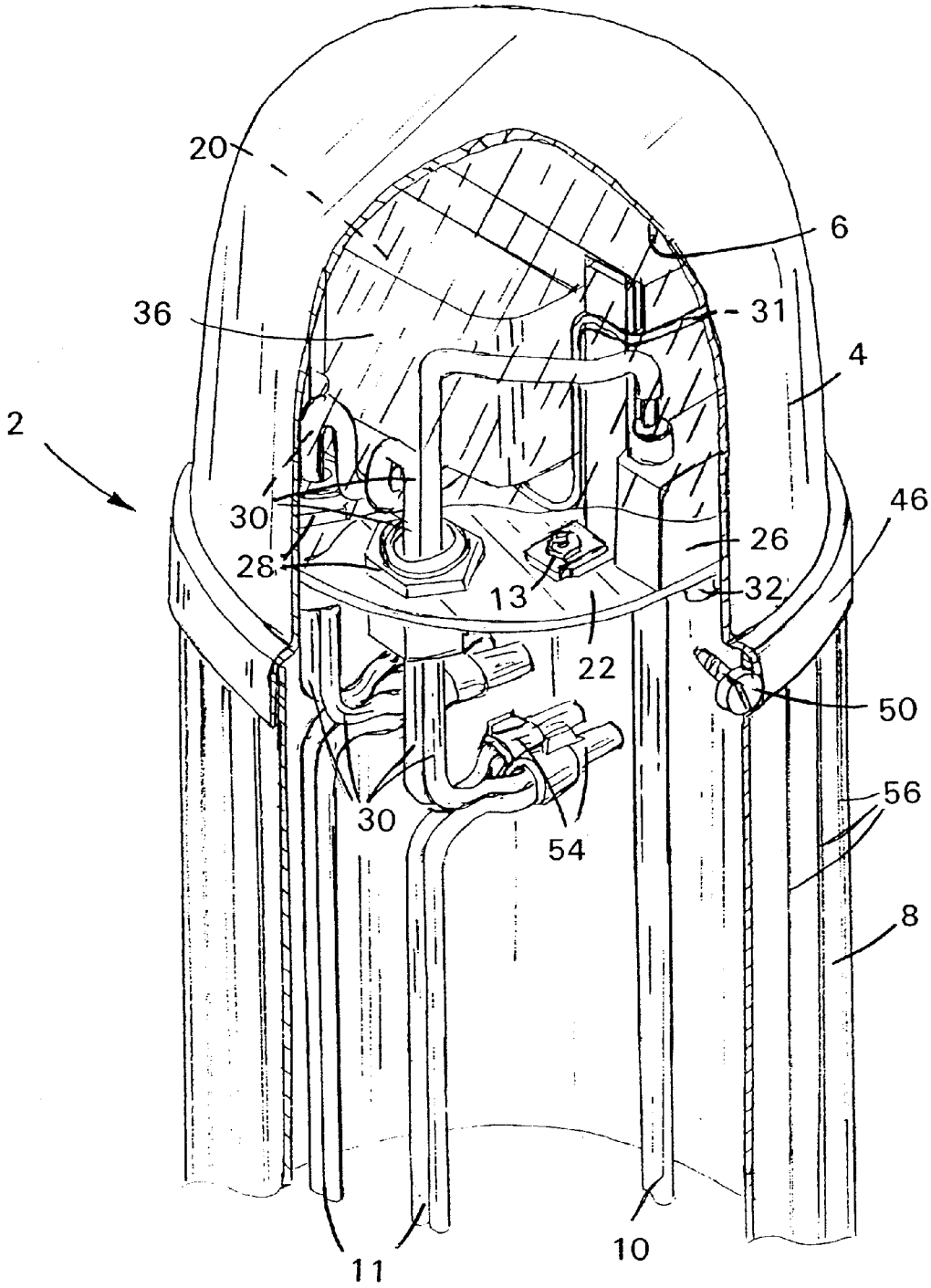
FIG. 1 is a perspective view, partially cut away, of a preferred embodiment of the transformer.
Figure 2:
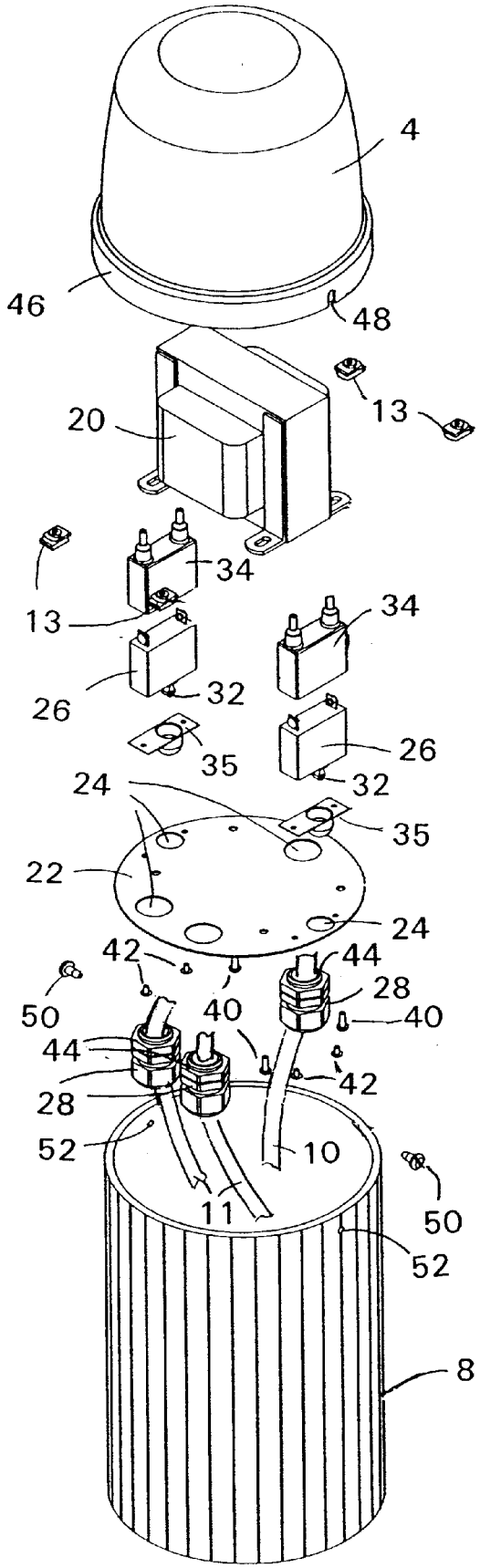
FIG. 2 is an exploded perspective view of the transformer of FIG. 1.

Referring now to the drawings wherein like numerals represent the same or equivalent structure and, in particular, to FIGS. 1 and 2, the transformer assembly comprises a housing 2 with a top portion 4 having a cavity 6 within which a transformer 20 is sealed using a waterproof sealant and a body portion 8 which is generally hollow for supporting the top portion and for providing a pathway for feeding cables 10,11 into the housing for connection to the transformer 20 primary and secondary, respectively. As illustrated, the transformer 20 has two taps (0V and 12V), so two output cables 11 are shown. The transformer, which in the illustrated embodiment is rated 600VA, is mounted on a plate 22 using a plurality of clip-on nuts 13 and corresponding screws 15. Plate 22 is formed from a plastic, polymer or ceramic (i.e., non-conductive material) and is retained within the cavity 6 in the top portion 4. The plate 22, which has a plurality of openings 24 therethrough, also supports an optional at least one circuit breaker 26 and at least one liquid-tight fitting 28 through which wires 30 are passed to connect to the transformer 20 and other components in the transformer circuit. Such fittings are commercially available, for example, liquid tight straight-thru fitting part number 3234 from Heyco Products, Inc. (Toms River, N.J.). Selection of other appropriate fittings is within the level of skill in the art.

As illustrated, there are two AC circuit breakers 26, one disposed on either side of the transformer 20. In order to comply with UL Standard 1838, which requires that low voltage power supplies be limited to 25 amps on the low voltage secondary side, for the 600 W transformer there are two circuits at 25 amps (300 watts) each, with one circuit breaker for each circuit. In an alternate embodiment using a 300 VA rated transformer, only one circuit breaker is needed. Also mounted on plate 22 are three fittings 28, one for each input 10 and output cable 11. Each circuit breaker 26 is positioned over an opening 24 through the plate 22 allowing access to its reset switch 32 in the event a short occurs. Each circuit breaker 26 is sealed within flexible silicone boots 34, 35 so that the top and bottom, respectively, of the circuit breaker are sealed against moisture while still allowing the reset switch 32 to be pressed. After the transformer 20, circuit breakers 26, inside boots 34,35, and fittings 28 are mounted on top of plate 22, and the appropriate electrical connections are made using wires 30, 31 (shown only in FIG. 1), the assembly is placed inside top portion 4.

Top portion 4, which in the preferred embodiment is generally dome-shaped with a circular cross-section, is then filled with a moisture-proof filler such as epoxy resin 36 or potting compound which encases the transformer 20, the at least one circuit breaker 26 and upper boot 34, the upper surface 38 of the plate 22, all fasteners 40, 42 that are used to attach the transformer 20 and at least one circuit breaker 26 to the plate 22, and the upper ends 44 of the liquid tight fittings 28. The epoxy 36 fully encapsulates the electrical components to prevent moisture penetration and to dampen transformer hum. The preferred epoxy 36 is of a type that is thermally conductive so that heat from the transformer 20 is conducted to the surface of top portion 4, allowing heat to be dissipated to prevent overheating. Such epoxies and potting compounds are widely available commercially, e.g., from RBC Industries, Inc. (Warwick, R.I.) and Mereco Technologies Group (West Warwick, R.I.), and Epoxy Technology Inc. (Billerica, Mass.), and selection of an appropriate epoxy or potting compound is within the level of skill in the art.

In the preferred embodiment, top portion 4 of the housing 2 is formed from copper which will patine into natural shades of greens and browns to complement a garden setting. Alternatively, the top portion 4 can be a powder-coated metal in a color that will blend into or complement the surrounding area. A lip 46 formed on the lower edge of the top portion 4 has a diameter adapted to fit closely over the outer diameter of the body portion 8. Slots 48 formed in the lip 46 allow a screw 50 or other fastener to pass through into corresponding threaded openings 52 in the body portion 8 to secure the top portion to the body. Slots 48 are preferably open at the lower edge of lip 46 so that the screws 50 need not be removed completely, but instead merely loosened to allow the top portion 4 to be lifted away from the body portion 8.

Body portion 8 can be formed from plastic, polymer, powder-coated metal, copper, brass or other material. Preferably, body portion 8 is formed from an Underwriter's Laboratory VO fire-rated plastic. In the preferred embodiment, the body portion is a hollow cylinder, i.e., has a circular cross-section, however, other shapes may be used, including those having a cross-section that is an oval, or a polygon such as a triangle, square, hexagon, octagon, etc., as long as the cross-sections of the top portion and body portion fit closely together. A plurality of vertically-extending channels or ribs 56 are formed in the outer surface of the body portion 8 to prevent dirt, accumulated mineral deposits, or other debris from causing the top portion 8 to seize up and prevent removal of the top 4 from the body portion 8. It may be desirable to utilize an O-ring at the point of contact between the inside of lip 46 and outer diameter of body portion 8 to minimize the amount of water that can enter at the joint.

Connection between the conductors 30 attached to the electrical components within the top portion and cables 10, 11 from the voltage source (120 VAC in) and to the light fixtures (12V out) occurs within body portion 8 by way of waterproof connectors 54. In the preferred embodiment, Underwriters Laboratory (UL) -approved direct burial connectors are used.

Figure 3:
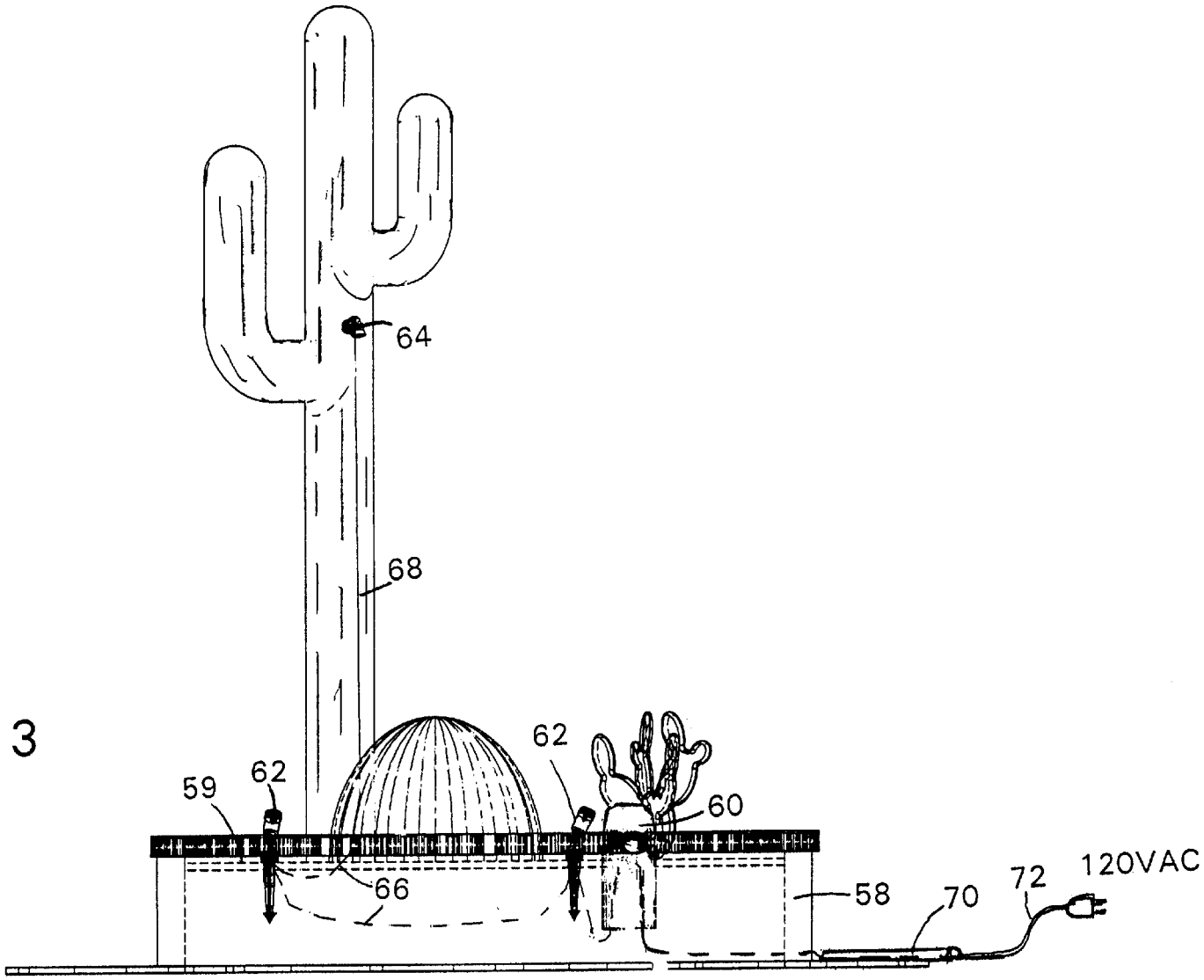
FIG. 3 is a diagrammatic view of a transformer according to the present invention installed within an island planter with two light fixtures.

As illustrated in FIG. 3, transformer assembly 60 is placed within an island planter 58 in close proximity to light fixtures 62 and 64, thus minimizing the length of cable 66 and 68 between the transformer and the fixtures 62, 64. The body portion 8 is partially buried in the ground 59, e.g., soil, sand, bark or other ground cover medium, such that the cables entering the assembly 60 are also buried. Input voltage, 120 VAC, is provided by running a line 72 from the source, usually at a nearby building, through a buried conduit or above-ground cable protector 70, through the planter wall and up into the bottom opening of the transformer assembly 60 for connection to the transformer. Thus, instead of having extended lengths of heavy gauge conductive cable for carrying the low voltage from the transformer to the light fixtures, the only extended length of cable 72 is for the one 120 VAC input line, which uses smaller gauge conductors. Preferably, however, the 120 VAC is pre-wired to the island planter 58 so that even the input cable will be relatively short.

The transformer assembly disclosed herein provides a solution to the long-standing problem of optimal placement of transformers in low voltage environmental lighting systems by providing an attractive yet durable transformer that can be placed in close proximity to the light fixtures. The design disclosed herein is compliant with Underwriter's Laboratories Standard 1838 as required for low voltage lighting systems While various embodiments of this invention have been described above, these descriptions are given for purposes of illustration and explanation. Variations, changes, modifications and departures from the systems and methods disclosed above may be adopted without departure from the spirit and scope of this invention.

I claim:

1. A transformer assembly for a low voltage light system comprising:

a housing having a top portion removably disposed on a body portion;

a plate disposed within the top portion of the housing, the plate having a first surface, a second surface and plurality of openings therethrough;

a transformer mounted on the first surface of the plate;

input and output electrical conductors having first ends connected to the transformer;

at least one water-tight fitting extending through the plate through another opening of the plurality of openings for passing the electrical conductors from the first side of the plate to the second side of the plate;

a moisture-proof filler for encapsulating the first surface of the plate, the transformer, a portion of the electrical conductors and a portion of the watertight fitting within the top portion; and connectors disposed within the body portion and attached to second ends of the electrical conductors for connecting the input electrical conductor to a voltage source cable and for connecting the output electrical conductor to a light fixture cable;

wherein the body portion is at least partially buried in the ground near at least one light fixture and the voltage source cable and the light fixture cable enter the housing through an opening in a bottom of the body portion.

2. The transformer assembly of claim 1, further comprising at least one circuit breaker electrically connected to the transformer and mounted on the first surface of the plate, the at least one circuit breaker having a reset switch, wherein the reset switch is disposed over an opening of the plurality of openings through the plate; and a flexible boot for covering the at least one circuit breaker;

wherein a portion of the flexible boot is encapsulated in the water-proof filler.

3. The transformer assembly of claim 2, wherein the flexible boot is formed from silicone.

4. The transformer assembly of claim 2, wherein the transformer is rated 600 VA and the at least one circuit breaker comprises two AC circuit breakers.

5. The transformer assembly of claim 2, wherein the transformer is rated 300 VA and the at least one circuit breaker comprises one AC circuit breaker.

6. The transformer assembly of claim 1, wherein the top portion has a lip adapted to fit over an outer diameter of the body portion.

7. The transformer assembly of claim 6, wherein the lip has a plurality of slots formed therein, and wherein the body portion has a plurality of bores corresponding to the plurality of slots, each bore adapted for receiving a fastener that is passed through the corresponding slot.

8. The transformer assembly of claim 1, wherein the moisture-proof filler is a thermally conductive epoxy.

9. The transformer assembly of claim 1, wherein the top portion is formed in a dome-shape.

10. The transformer assembly of claim 1, wherein the top portion is formed from copper.

11. The transformer assembly of claim 1, wherein the connectors are direct burial connectors.

12. A transformer assembly for a low voltage environmental lighting system comprising:

a body comprising a hollow tube having an outer diameter;

a top portion having a lower edge adapted to fit over the outer diameter of the body;

a plate having a first surface, a second surface and plurality of openings therethrough;

a transformer mounted on the first surface of the plate;

input and output electrical conductors having first ends connected to the transformer;

at least one water-tight fitting extending through the plate through another opening of the plurality of openings for passing the electrical conductors from the first side of the plate to the second side of the plate;

an epoxy filler disposed within the top portion for encapsulating the first surface of the plate, the transformer, a portion of the electrical conductors and a portion of the water-tight fitting; and water-tight connectors disposed within the body and attached to second ends of the electrical conductors for connecting the input electrical conductor to a voltage source cable and for connecting the output electrical conductor to a light fixture cable;

wherein a lower portion of the body is buried in the ground near at least one light fixture and the voltage source cable and the light fixture cable enter the housing through an opening in the lower portion of the body.

13. The transformer assembly of claim 12, further comprising at least one circuit breaker electrically connected to the transformer and mounted on the first surface of the plate, the at least one circuit breaker having a reset switch, wherein the reset switch is disposed over an opening of the plurality of openings through the plate; and a flexible boot for covering the at least one circuit breaker;

wherein a portion of the flexible boot is encapsulated in the moisture-proof filler.

14. The transformer assembly of claim 13, wherein the flexible boot is formed from silicone.

15. The transformer assembly of claim 13, wherein the transformer is rated 600 VA and the at least one circuit breaker comprises two AC circuit breakers.

16. The transformer assembly of claim 13, wherein the transformer is rated 300 VA and the at least one circuit breaker comprises one AC circuit breaker 10.

17. The transformer assembly of claim 12, wherein the epoxy filler is a thermally conductive epoxy.

18. The transformer assembly of claim 12, wherein the top portion is formed in a dome-shape.

19. The transformer assembly of claim 12, wherein the top portion is formed from copper.

20. The transformer assembly of claim 12, wherein the water-tight connectors are direct burial connectors.

21. A transformer assembly for a low voltage environmental lighting system comprising:

a body comprising a hollow tube having an outer diameter, the body having a plurality of bores for receiving a fastener;

a domed top having a lip on a lower edge adapted to fit over the outer diameter of the body, the lip having a plurality of slots corresponding to the plurality of bores in the body;

a plurality of fasteners for insertion through the plurality of slots into the plurality of bores;

a plate assembly encapsulated in a moisture-proof filler, the plate assembly comprising:

a plate having a first surface, a second surface and plurality of openings therethrough;

a transformer mounted on the first surface of the plate;

at least one circuit breaker mounted on the first surface of the plate and electrically connected to the transformer, the at least one circuit breaker having a reset button accessible through at least one of the plurality of openings through the plate;

a flexible boot for encasing the at least one circuit breaker;

input and output electrical conductors having first ends connected to the transformer;

at least one water-tight fitting extending through the plate through another opening of the plurality of openings for passing the electrical conductors from the first side of the plate to the second side of the plate; and water-tight connectors disposed within the body and attached to second ends of the electrical conductors for connecting the input electrical conductor to a voltage source cable and for connecting the output electrical conductor to a light fixture cable.

22. The transformer assembly of claim 21, wherein the flexible boot is formed from silicone.

23. The transformer assembly of claim 21, wherein the transformer is rated 600 VA and the at least one circuit breaker comprises two AC circuit breakers.

24. The transformer assembly of claim 21, wherein the transformer is rated 300 VA and the at least one circuit breaker comprises one AC circuit breaker 10.

25. The transformer assembly of claim 21, wherein the epoxy filler is a thermally conductive epoxy.

26. The transformer assembly of claim 21, wherein the top portion is formed from copper.

27. The transformer assembly of claim 21, wherein the water-tight connectors are direct burial connectors in the desired position further includes using a level.

* * * * *